United States Patent [19]

Ueno et al.

[11] Patent Number: 4,606,930

[45] Date of Patent: Aug. 19, 1986

[54] METHOD FOR TREATING FIBERS

[75] Inventors: Katsuji Ueno, Hirakata; Hiroaki Sugimoto, Takatsuki; Kazuo Hayatsu, Ibaraki, all of Japan

[73] Assignee: Sumitomo Chemical Company, Limited, Osaka, Japan

[21] Appl. No.: 704,760

[22] Filed: Feb. 25, 1985

[30] Foreign Application Priority Data

Mar. 2, 1984 [JP] Japan ..... 59-40834
Mar. 2, 1984 [JP] Japan ..... 59-40835

[51] Int. Cl.[4] ..... B05D 3/06

[52] U.S. Cl. ..... 427/40; 204/165; 428/395; 428/480; 156/272.6; 156/910

[58] Field of Search ..... 427/40, 39; 428/480, 428/395; 204/165; 152/451, 458, 565; 156/272.6, 910

[56] References Cited

U.S. PATENT DOCUMENTS 3,477,902 11/1969 Tomasino et al. ..... 156/272.6
3,888,753 6/1975 Kiikka et al. ..... 204/165
4,072,769 2/1978 Lidel ..... 427/40
4,091,855 5/1978 Sibilia et al. ..... 152/451
4,159,365 6/1979 Payet ..... 428/480
4,219,629 8/1980 Storm ..... 428/480
4,390,683 6/1983 Yatsu et al. ..... 428/480
4,418,122 11/1983 Rieder et al. ..... 428/480

*Primary Examiner*—John H. Newsome
*Attorney, Agent, or Firm*—Stevens, Davis, Miller & Mosher

[57] ABSTRACT

A method for treating fibers which comprises modifying the surface of a fiber of a polyester which shows anisotrophy in the molten state by subjecting the fiber to a low-temperature plasma irradiation, said method enabling to obtain fibers which comprise highly oriented molecules, are highly crystalline and hence exhibit a high tenacity and a high modulus of elasticity.

The fibers thus obtained are suitable as a reinforcing material, exhibit an excellent adhesion to matrices to be reinforced and can give a satisfactory strength to the resulting composite material.

3 Claims, No Drawings

METHOD FOR TREATING FIBERS

This invention relates to a method for treating fibers to obtain treated fibers suitable as a reinforcing material. More particularly, it relates to a method for treating fibers to obtain treated fibers suitable as a reinforcing material which exhibit an excellent adhesion to matrices to be reinforced and can give a satisfactory strength to the resulting composite material.

Fibrous materials which are known as a reinforcing material suitable to be used in composite materials include glass fibers, carbon fibers, alumina fibers, steel fibers and aramid fibers. It has recently been revealed, as disclosed for example in Japanese Patent Publication No. 20,008/80, that some kinds of polyesters show anisotropy in the molten state and give, by melt spinning, fibers exhibiting a high tenacity and a high modulus of elasticity. These fibers are expected to be suitable as a reinforcing material used in forming composite material when their light weight is taken into consideration together with above-mentioned excellent properties. However, when a composite material was formed by using various kinds of thermosetting resins or thermoplastic resins as the matrix and using a fiber formed of the polyester showing anisotropy in the molten state mentioned above as the reinforcement, it turned out that there exists a big problem to be confronted. Namely, the adhesion at the interface between the reinforcement, the fiber, and the matrix, the resin, in the composite material is not sufficiently good and consequently there appears a phenomenon that such physical properties in which the adhesiveness between the matrix and the reinforcement is an important factor as, for example, shear strength cannot be fully manifested.

The present inventors made extensive studies in view of the above-mentioned circumstances. As a result, it has been found that treated fibers which can exhibit an excellent adhesion to matrices to be reinforced and can give a satisfactory strength to the resulting composite material as a whole can be obtained by subjecting above-mentioned fibers to a specified treatment.

Thus, this invention relates to a method for treating fibers which comprises modifying the surface of a fiber of a polyester which shows anisotropy in the molten state by subjecting the fiber to a low-temperature plasma irradiation.

The "polyester which shows anisotropy in the molten state" referred to in this invention means a polyester which, when a specimen thereof is placed between two polarizers crossed at 90° and heated to raise its temperature, permits passage of polarized light through it in the molten state. Such polyesters include polyesters formed of suitable combinations of an aromatic dicarboxylic acid such as terephthalic acid, isophthalic acid, naphthalene-2,6-dicarboxylic acid, 4,4'-dicarboxydiphenyl and 1,2-bis(4-carboxyphenoxy)ethane, and an aromatic diphenol such as hydroquinone, chlorohydroquinone, phenylhydroquinone, resorcinol, 4,4,'-dihydroxydiphenyl, and 2,6-dihydroxynaphthalene, and/or an aromatic hydroxycarboxylic acid such as p-hydroxybenzoic acid, m-hydroxybenzoic acid, and 2-hydroxynaphthalene-6-carboxylic acid. Preferred examples of polyesters formed of the above combinations are as follows:

(1) Copolyesters formed of 40 to 70% by mole of p-hydroxybenzoic acid, 15 to 30% by mole of the above-mentioned aromatic dicarboxylic acid, and 15 to 30% by mole of the aromatic diphenol.

(2) Copolyesters formed of terephthalic acid and/or isophthalic acid, and chlorohydroquinone, phenylhydroquinone and/or hydroquinone.

(3) Copolyesters formed of p-hydroxybenzoic acid and 2-hydroxynaphthalene-6-carboxylic acid.

The above-mentioned polyesters may be prepared by using known methods, for example suspension polymerization, bulk polymerization and interfacial polymerization. The resulting polyesters are preferably heat-treated before spinning under atmospheric or reduced pressure.

The above-mentioned polyesters can be formed into fibers by using conventional melt-spinning equipments. The fibers thus obtained can be used as such or can be heat-treated, or stretched, or further heat-treated after stretching to be treated according to this invention. The fibers thus obtained comprise highly oriented molecules, are highly crystalline, and hence exhibit a high tenacity and a high modulus of elasticity.

The fibers are then subjected to a low-temperature plasma irradiation, whereby the adhesive property of the surface of the fiber is improved, resulting in full manifestation of the strength of a composite material obtained when the fiber is combined with a matrix.

The plasma treatment of the fiber can be conducted by such methods as treating the fibers batchwise for a predetermined period of time or treating them continuously. The fibers to be treated may be in various forms including filaments, yarns, ropes or woven goods.

The low-temperature plasma referred to in this invention means plasma formed by glow discharge, highfrequency discharge, corona discharge and the like. For example, plasma by glow discharge can be obtained in an evacuated vessel by impressing between electrodes a voltage of 0.5 to 50 kV of alternative current having a frequency of 50 to 13.56 MHz or of direct current while passing gases such as hydrogen, helium, argon, nitrogen, oxygen, carbon monoxide, carbon dioxide or ammonia or vapors of unsaturated organic compounds or organic cyclic compounds containing a hetero atom through the vessel so as to keep the pressure therein at 0.01 to 20 Torr. Examples of the unsaturated organic compounds include acrylonitrile, acrylic acid, 4vinylpyridine, allylamine, vinyl acetate, allyl alcohol, glycidyl acrylate, glycidyl methacrylate, sulfopropyl methacrylate, vinyl alkyl ethers, acrylamides, methyl methacrylate, styrene, cyclohexene, cyclopentadiene and allyl chloride. Examples of organic cyclic compounds containing a hetero atom (oxygen, nitrogen or sulfur atom) include pyridine, 4-ethylpyridine, 2,6-dimethylpyridine, ethylene oxide, propylene oxide, N-methylpyrrolidone, ethyleneimine, tetrahydrofuran, dioxane, lactones, thiophene, pyrrole and quinoline. Apparatuses as described in Japanese Patent Publication No. 038,988/77 can be used for the treatment.

Plasma by corona discharge can be obtained by applying a voltage between electrodes in the air or in an inert gas atmosphere to cause discharge.

The plasma irradiation treatment can give functional groups onto the surface of the fiber or increase the ruggedness of the surface. Consequently, the treated fibers can be combined with thermosetting resins or thermoplastic resins into composite materials with good adhesion by using various methods of processing. Resins which can be combined with the fibers treated according to this invention include epoxy resins, unsaturated polyester resins, phenol resins, silicone resins, rubbers, diallyl phthalate resins, polyolefins, polyesters, polyamides, polyamide-imides, polyethers, polysulfones, polysulfides and polyketones. The composite materials formed of these resins and the fibers can be used in various fields of applications such as aeroplanes, ships, vehicles, housing, sporting goods, household electric appliances or construction and information industry.

This invention will be illustrated in more detail below with reference to Examples, which are only for the purpose of illustration and should not be construed as limiting the scope of this invention.

REFERENTIAL EXAMPLE 1

Into a polymerization vessel were placed simultaneously 1080 g (6 moles) of p-acetoxybenzoic acid, 249 g (1.5 moles) of terephthalic acid, 83 g (0.5 mole) of isophthalic acid, and 540 g (2 moles) of 4,4'-diacetoxydiphenyl. Under nitrogen atmosphere and with stirring, the resulting mixture was brought from 180° to 330° C. over a period of 2 hours and polymerized at 330° C. for 3 hours. During the course of the polymerization, acetic acid resulting from the reaction was removed out of the system. The yield of the polymer taken out after cooling was 1,344 g (99.4% of theoretical). The polymer was pulverized and then treated in a nitrogen gas stream at 280° C. for 3 hours.

The polymer powders thus obtained were placed on a heating sample stage positioned between two polarizing plates crossed at 90° and their behavior was observed while heating. The flow of the polymer could be confirmed from about 300° C. upward and the quantity of transmitted polarized light increased with the increase of fluidity, revealing that the polymer showed melt anisotropy.

The polymer powders were melt-spun through an extruder-type spinning machine having a diameter of 30 mm at 360° C. into a continuous fiber having a filament number of 50. The fiber was then heat-treated in the air at 310° C. for 30 minutes. There was obtained a fiber having a tenacity of 310 kg/mm$^2$, an elongation of 2.8%, a modulus of elasticity of 12.8 t/mm$^2$ and a fiber diameter of 20 $\mu$m.

REFERENTIAL EXAMPLE 2

Into a polymerization vessel were placed simultaneously 1,364 g (5.05 moles) of 2,5-diacetoxybiphenyl and 830 g (5.00 moles) of terephthalic acid, and the mixture was polymerized with stirring in nitrogen atmosphere under the same conditions as in Referential Example 1. The yield of polymer was 1,517 g (95.5% of theoretical). The polymer was pulverized and then heat-treated in nitrogen atmosphere at 290° C. for 3 hours. When the polymer was examined under a polarized light for its melting behavior, the flow of the polymer could be observed from 315° C. upward and an increase in the quantity of transmitted polarized light could be confirmed simultaneously with the beginning of the flow, revealing that the polymer had a melt anisotropy.

After melt spinning and heat-treatment in nitrogen atmosphere at 310° C. for 3 hours there was obtained a continuous fiber having a filament number of 50, a tenacity of 280 kg/mm$^2$, an elongation of 3.0%, a modulus of elasticity of 10.9 t/mm$^2$ and a fiber diameter of 22 $\mu$m.

EXAMPLE 1

The fiber obtained in Referential Example 1 was subjected to a plasma irradiation treatment in the following manner.

Two electrodes were placed in a closed vessel having an inside diameter of 60 cm and a length of 2 m in the longitudinal direction. A fiber bobbin round which the fiber obtained in Referential Example 1 had been wound was fixed on one side of the vessel. A take-up bobbin having a driving device outside the vessel was placed on the opposite side of the vessel. The system was provided with 8 pulleys each having a bearing so that the fiber let off from the fiber bobbin might move back and forth nine times in the plasma stream until it was wound round the take-up bobbin. Plasma treatment was conducted by keeping the pressure in the vessel at 0.2 Torr. with helium gas, impressing an A.C. voltage of 3.0 kV between the electrodes by means of a gas-tube sign transformer, and moving the fiber at a take-up speed of 2 m/min. in the plasma stream. The fiber was irradiated with plasma for about 6 minutes. The pressure inside the vessel was restored to ordinary pressure by using air.

The plasma-treated fiber thus obtained was used to form a pre-preg with an epoxy resin to examine its properties as a composite material according to the following procedures.

The plasma-treated fiber wound round a bobbin was passed under a tension through a bath containing a methyl cellosolve solution of an epoxy resin, Sumiepoxy ELM-434 (mfd. by Sumitomo Chemical Co., Ltd.) (epoxy resin concentration: 50%) and wound round a drum having a circumference of 66 cm. An amine-type curing agent had been added to the epoxy resin solution. The bundle of fibers impregnated with resin on the drum was cut into a sheet 66 cm in length and 20 cm in width and then heat-treated at 130° C. for 20 minutes to convert it into B stage. The sheet was folded in the fiber direction so as to have a width of about 6 mm. Several of the thus folded sheets were put in piles into a mold of 6 mm width and pressed at 170° C. for 1 hour to give a thickness of the formed article of 2 mm. The composite material was so designed beforehand that the volume fraction of the fiber ($V_f$) in the material might become 50 to 60%.

The formed article was then postcured at 200° C. and a block having a dimension of 20 mm (length)×2 mm (thickness)×6 mm (width) was cut out therefrom to determine the interlaminar shear strength (ILSS) by the three-points bending method. The determination was conducted at a span between the supporting points of 4 times the thickness of the formed article and a crosshead speed of 1 mm/min.. The ILSS was calculated from the following equation.

$$\text{ILSS} = \tfrac{3}{4} \times (\text{Breaking load}) / [(\text{Specimen width}) \times (\text{Specimen thickness})]$$

The number of specimens used in the determination was 10.

The volume fraction of the fiber ($V_f$) in the epoxy composite material containing the fiber was determined by first measuring the weight of the fiber by dissolving out the epoxy resin with tetrahydrofuran from the material in the state of B stage and then calculating its proportion in the total weight of the formed, cured article. The value of $V_f$ in this Example was 57%. The value of ILSS in this case is shown in Table 1 together with that in Comprative Example 1 wherein a fiber not subjected to plasma treatment was used. Table 1 reveals clearly the effect of the treatment of this invention.

COMPARATIVE EXAMPLE 1

An epoxy resin composite material was prepared in the same manner as in Example 1 except that the same fiber as used in Example 1 was used without being subjected to the treatment of this invention. The value of $V_f$ in the composite material was 55%. The value of ILSS, as indicated in Table 1, shows that the composite material does not posses a satisfactory strength because of insufficient adhesion between the fiber and the resin.

TABLE 1

| Example | Effect of fiber surface treatment on ILSS: Plasma treatment | $V_f$(%) | ILSS (kg/mm$^2$) |
|---|---|---|---|
| Example 1 | Yes | 57 | 9.2 |
| Comparative Example 1 | No | 55 | 3.9 |

EXAMPLE 2

The fiber obtained in Referential Example 1 was subjected to plasma treatment by using acrylic acid vapor in place of helium gas used in Example 1 at a pressure of 0.3 Torr., an impressed AC voltage of 3 KV and a travelling speed of the fiber of 1.5 m/min.. An epoxy composite material was prepared by using the plasma-treated fiber obtained above to determine its ILSS. It was found that the ILSS value obtained, 9.5 kg/mm$^2$, was higher than that in Comparative Example 1. The $V_f$ of the composite material was 59%.

EXAMPLE 3

The fiber obtained in Referential Example 1 was used to be subjected to plasma treatment by corona discharge. A high-frequency power source (5 Hz, 2 KW) (mfd. by Kasuga Denki Co.) was used for the apparatus. Mylar film of 20 μm thickness was wound round an earthed metal roll 20 cm in diameter and the fiber obtained in Referential Example 1 was wound thereon so as to leave no space in between. An aluminum electrode plate having the same length as that of the roll was positioned so as to have a distance of about 5 mm from the fiber wound round the roll and electric discharge was conducted at a room temperature of 23° C. and a relative humidity of 47%. The roll was rotated at a velocity of 16 r.p.m. and plasma irradiation was conducted intermittently for 45 seconds. The fiber thus obtained was formed into a composite material together with an epoxy resin and the interlaminar shear strength (ILSS) of the resulting material was determined in the same manner as in Example 1. The volume fraction of the fiber ($V_f$) in the specimen was 58% and the ILSS was 7.0 kg/mm$^2$. It can be seen that the ILSS is markedly increased as compared with that in Comparative Example 1.

EXAMPLE 4

The fiber obtained in Referential Example 2 was used to be subjected to plasma irradiation in the same manner and under the same conditions as in Example 1.

An epoxy resin composite material was prepared by using the fiber thus treated to determine its interlaminar shear strength (ILSS). The results obtained are shown in Table 2 together with those obtained in Comparative Example 2 wherein an untreated fiber was used. The Table reveals that the adhesion between the fiber and the matrix is improved by the plasma-treatment.

TABLE 2

| Example | Effect of fiber surface treatment on ILSS: Plasma treatment | $V_f$ in composite material (%) | ILSS (kg/mm$^2$) |
|---|---|---|---|
| Example 4 | Yes | 58 | 8.0 |
| Comparative Example 2 | No | 56 | 3.4 |

EXAMPLE 5

A test of reinforcing polybutylene terephthalate was conducted by using the fiber subjected to the treatment according to this invention in Example 1. The polybutylene terephthalate used was Toray 1401 (mfd. by Toray Co.).

The fiber was used as it was in the form of a long fiber and, together with the resin, extruded and pelletized by using a 30 mm twin-screw kneader-extruder PCM-30 (mfd. by Ikegai Tekko Co.). The weight ratio of the fiber to the resin was 30:70. A dumbbell test piece was molded by using a Neomat 1-oz. injection molding machine (mfd. by Sumitomo Shipbuilding & Machinery Co.) at a molding temperature of 270° C. and a mold temperature of 80° C.

The test piece was subjected to a tensile test with a distance between chucks of 40 mm and a stretching velocity of 5 mm/min.. The results obtained are shown along with those in Comparative Example 3 wherein a fiber not subjected to plasma treatment was used. The table reveals that the adhesion between the fiber and the matrix is improved by the treatment of this invention.

TABLE 3

| Example | Comparison of properties of polybutylene terephthalate composite material: Treatment of this invention | Tensile strength (kg/cm$^2$) | Tensile modulus of elasticity (t/cm$^2$) |
|---|---|---|---|
| Example 5 | Yes | 1,410 | 43 |
| Comparative Example 3 | No | 1,230 | 32 |

What is claimed is:

1. A method for treating fibers which comprises modifying the surface of a fiber of a wholly aromatic polyester which shows anistropy in the molten state by subjecting the fiber to a low-temperature plasma irradiation.

2. A method for treating fibers according to claim 1, wherein the polyester is (1) a copolyester formed of 40 to 70% by mole of p-hydroxybenzoic acid, 15 to 30% by mole of an aromatic dicarboxylic acid, and 15 to 30% by mole of an aromatic diphenol;

(2) a copolyester formed of terephthalic acid and/or isophthalic acid, and chlorohydroquinone, phenylhydroquinone and/or hydroquinone; or (3) a copolyester formed of p-hydroxybenzoic acid and 2-hydroxynaphthalene-6-carboxylic acid.

3. A method for treating fibers according to claim 1, wherein the low-temperature plasma is a plasma formed by glow discharge or corona discharge.

* * * * *